US006474130B2

(12) United States Patent
Battenfeld

(10) Patent No.: US 6,474,130 B2
(45) Date of Patent: Nov. 5, 2002

(54) PLIERS FOR CRIMPING WORK PIECES

(75) Inventor: Kurt Battenfeld, Ebsdorfergrund-Wittelsberg (DE)

(73) Assignee: Wezag GmbH Werkzeugfabrik, Stadtallendorf (DE)

( * ) Notice: Subject to any disclaimer, the term of this patent is extended or adjusted under 35 U.S.C. 154(b) by 0 days.

(21) Appl. No.: 09/739,173

(22) Filed: Dec. 18, 2000

(65) Prior Publication Data

US 2001/0006001 A1 Jul. 5, 2001

(30) Foreign Application Priority Data

Dec. 24, 1999 (DE) ..... 199 63 097

(51) Int. Cl.[7] ..... B21D 7/06

(52) U.S. Cl. ..... 72/409.07; 72/409.12; 81/313; 81/393

(58) Field of Search ..... 72/409.07, 409.12; 81/313, 427.5, 393; 74/525, 544, 522, 523

(56) References Cited

U.S. PATENT DOCUMENTS

| | | | | | |
|---|---|---|---|---|---|
| 1,123,243 | A | * | 1/1915 | Champ | 81/393 |
| 2,410,889 | A | | 11/1946 | Martines | 81/46 |
| 3,837,211 | A | * | 9/1974 | Gress | 72/410 |
| 4,144,737 | A | * | 3/1979 | Izraeli | 72/409 |
| 4,158,302 | A | * | 6/1979 | O'Loughlin | 81/313 |

FOREIGN PATENT DOCUMENTS

| | | |
|---|---|---|
| DE | 1172145 | 6/1964 |
| DE | 2559656 | 4/1981 |
| DE | 4313996 | 7/1994 |
| DE | 197 09 639 A1 | 9/1998 |

* cited by examiner

*Primary Examiner*—Daniel C. Crane
(74) *Attorney, Agent, or Firm*—Klauber & Jackson

(57) ABSTRACT

Pliers for crimping work pieces include a pliers head and two pivot jaws (3, 4) being arranged in the region of the pliers head. A common joint (5) pivotally connects the two pivot jaws (3, 4). Two dies forming a crimping die (8) for crimping the work piece are arranged at the two pivot jaws (3, 4). Two handles (1, 2) are connected to the pivot jaws (3, 4), and they each include an end portion (20, 23) facing away from the pliers head. At least one of the handles (1, 2) is divided into at least two portions (21, 22). The handles (1, 2) are designed and arranged to be movable with respect to one another and to be operable to crimp the work piece in a few crimping steps. One portion (22) of the divided handle (1, 2) is coupled to the other portion (21) in a plurality of different angle positions each corresponding to one crimping step in a way that the end portions (20, 23) may be held and operated by the fingers of one hand of the operator in each angle position of each crimping step. A locking mechanism (31) is designed and arranged to attain a defined closed position of the dies. A toggle lever drive includes a plurality of supporting joints (13, 17) and a pressure lever (16) connecting the two handles (1, 2). The pressure lever (16) is supported by the plurality of supporting joints (13, 17).

15 Claims, 5 Drawing Sheets

PLIERS FOR CRIMPING WORK PIECES

CROSS REFERENCE TO RELATED APPLICATIONS

This application claims the benefit of co-pending German Patent Application No. 199 63 097.6 entitled "Zange zum Verpressen eines Werkstüicks" filed on Dec. 24, 1999.

FIELD OF THE INVENTION

The present invention generally relates to pliers for crimping work pieces. More particularly, the present invention relates to pliers being operable with one hand and serving to apply great crimping forces onto the work piece in a few crimping steps.

BACKGROUND OF THE INVENTION

Pliers of this kind are also called crimping pliers or pressing pliers. Depending on the design of the work piece, especially in case of fittings, tubes and the like to be crimped, substantial pressing forces have to be applied onto the work piece. On the other hand, such work pieces may have comparatively great dimensions. Consequently, the crimping die being formed by two dies should have a great opening in the opened position of the pliers to be able to move the two dies over the work piece to be crimped in the opened position of the pliers. At the beginning of the closing movement of the pliers, there usually are no or at least no substantial pressing forces to be overcome. Contrarily, the pressing forces to be applied during the actual crimping movement of the work piece are substantial.

Pliers for crimping work pieces are known from German patent application DE 197 09 639 A1. The pliers include two handles being movable with respect to one another by one hand. A joint supports two pivot jaws. One of the two pivot jaws is connected to a stationary handle to form a stationary portion of the pliers. The other pivot jaw is pivotally connected to the stationary portion of the pliers by the joint. The pliers include separated dies forming a crimping die. A locking mechanism is arranged between the stationary handle and the movable handle, and it serves to reach a defined end position of the separated dies. The handles may first be reopened after one crimping process has been finished, after the end position has been reached and after the locking mechanism has released the handles. A pressure lever is arranged between the handles, and it is pivotally supported by the supporting joint. The pressure lever together with a section of the movable handle forms a toggle lever drive. This sole pressure lever is supported in a supporting joint including an eccentric surface allowing for an adjustment of the effective length of the pressure lever. The adjustability of the pressure lever serves to compensate work tolerances to exactly associative a closing position of the handles with an end crimping position of the pliers. It is also possible to adjust the pressure lever to eliminate wear and tear occurring at the connected joints or the dies. The two dies and the corresponding pivot jaws are designed as one piece. The fixed connection of the combined pivot jaw/die to the stationary handle is disadvantageous. The maximum applicable crimping forces are limited. Additionally, the preciseness of the finished crimped work piece highly depends on the realizable process tolerances with which the elements of the pliers are produced and which are used to assemble the pliers. Consequently, it is necessary to rework the dies of the pliers in many cases. The known pliers include handles made of molded plastic. These handles provide great stability at reduced exactness. Since the material flows, disadvantageous displacements of, for example, prearranged bores cannot be prevented. With the known pliers, the work piece is crimped in one crimping step.

Clamping pliers are known from German patent DE 25 59 656 B2. The clamping pliers include two handles being movable with respect to one another. Two pivot jaws are rotatable about a common joint. One of the pivot jaws is connected to a stationary handle to form a stationary pliers portion. The other pivot jaw is pivotally connected to the stationary pliers portion by the joint. A pressure lever is arranged between the two handles. The pressure lever is pivotal about a supporting joint and, together with a section of the stationary handle, it forms a toggle lever drive. To adjust the effective length of the pressure lever despite the fixed connection of the pressure lever at both ends at the handles, at least one of the supporting joints includes an eccentric tappet including different angle positions to adjust the kinematics of the clamping pliers, especially of the end position during the closing movement of the pivot jaws.

German patent DE 25 55 071 C2 additionally shows the application of a locking mechanism being arranged between the pressure lever and the stationary handle to reproducibly attain the defined end position of the pliers.

Clamping pliers including two handles being movable with respect to one another and two pivot jaws being pivotal about a common joint are known from U.S. Pat. No. 2,410,889. Each of the pivot jaws is connected to the associated handle to form a fixed pliers portion therewith. One of the two handles is divided into two portions each forming a lever to crimp the work piece in a few crimping steps. The two portions of the handle are interconnected by a joint to be pivotal with respect to one another. The portion of the handle to be held by the hand of the operator is lengthened in the direction towards the pliers head to extend beyond the joint to form a lever arm serving for transmission. A pulling lever is pivotally connected to the free end of the handle. The pulling lever encloses the two handles, and it is supported at the other handle not being divided. In this way, one portion of the divided handle is coupled to the other handle not being divided in each crimping step in different angle positions changing during the crimping process in a way that the end portions of the two handles facing away from the pliers head may be held and operated by the fingers of one hand in each angle position of each crimping step. Due to the division and support of the one handle at the other handle, there is an additional transmission of the actuation force to be applied by hand.

SUMMARY OF THE INVENTION

Briefly described, the present invention provides pliers for crimping work pieces. The pliers include a pliers head, a first pivot jaw being arranged in the region of the pliers head and a second pivot jaw being arranged in the region of the pliers head. A common joint pivotally connects the first and second pivot jaw. A first die is arranged at the first pivot jaw. A second die is arranged at the second pivot jaw. The first die and the second die together form a crimping die for crimping the work piece. A first handle is operatively connected to the first pivot jaw, and it includes an end portion facing away from the pliers head. The first handle is divided into at least a first portion and a second portion. A second handle is operatively connected to the second pivot jaw, and it includes an end portion facing away from the pliers head. The first and second handle are designed and arranged to be movable with respect to one another and to be operable to crimp the work piece in a few crimping steps. The second portion of the first handle is coupled to the first portion of the first handle in a plurality of different angle positions each corresponding to one crimping step in a way that the end portions of the first and second handle may be held and operated by the fingers of one hand of the operator in each angle position of each crimping step. A locking mechanism is designed and arranged to attain a defined closed position of the first and second die. A toggle lever drive includes a plurality of supporting joints and a pressure lever operatively connecting the first and second handle. The pressure lever is supported by the plurality of supporting joints.

The present invention is based on the concept of designing the pliers user friendly and appropriate for applying great crimping forces. It is desired to ensure that the pliers may be used and operated by one hand. This means that the handles need to be designed in a way that they may be grasped by the fingers of one hand of the user already at the beginning of each crimping step and that they may be pressed towards each other during the crimping stroke. On the other hand, it is desired to be able to apply crimping forces of up to 3 to 5 tons and more onto the work piece, even during overhead or narrow working conditions.

In the prior art, it is only possible to apply such great crimping forces with crimping tools including an electrical drive or a hydraulic drive. The pliers according to the present invention are designed to attain these great crimping forces by realizing a plurality of crimping steps or stages.

At least one of the handles is divided into at least two portions each forming a part of the handle. Each part of the handle forms a lever arm. This sum of the lengths of the two lever arms corresponds approximately to the length of the lever arm of the other handle. The two portions of the divided handle are interconnectable and they support each other, respectively, in a different angle position in each crimping step. Thus, the end portions of the two handles facing away from the pliers head may be grasped by the fingers of one hand of the operator in each angle position of each crimping step. The crimping steps result from a change of the angle position of the portions of the divided handle with respect to each other. Generally, it is sufficient to realize two angle positions and, consequently, two crimping steps. However, in case of great requirements, there is the possibility of providing a few crimping steps one after the other. Realizing a few crimping steps means to provide at least two crimping steps up to approximately four crimping steps. In combination with a toggle lever drive, it is ensured that the part of the handle of the divided handle facing away from the pliers head is progressively dislocated with respect to the geometry of the toggle lever drive, especially with respect to the dead center of the toggle lever drive, in each crimping step. The ratio of transmission of the toggle lever drive is used during each crimping step. In this way, the necessary operating forces to be applied manually are kept low.

The novel pliers have a short structural length and a comparatively little weight. The pliers are at least operable by one hand of the user in the crimping steps. This means that the free end portions of the handles at the beginning of each crimping step are located in a position in which the distance between them is less than approximately 110 mm. However, the operator may use both hands to increase the hand forces. In case three crimping steps are realized, both handles may be divided.

The locking mechanism is operable located between the fixed handle and the pivot jaw being pivotal about the joint. The locking mechanism does not transmit crimping forces, but it only serves to reproducibly reach a defined end position of the dies and to attain crimping results of constant quality at a series of work pieces having the same dimensions. The arrangement of the locking mechanism in the pliers is of substantial importance. The jack of the locking mechanism is resiliently movable but stationary. The jack may be arranged at the fixed handle, the locking mechanism preferably including a tooth segment including a low number of teeth having a comparatively great pitch. The tooth segment is arranged at the movable pivot jaw, or at least it is connected thereto. With this arrangement, the pliers are adjustable such that the end position is safely attained in the last crimping step, and that an especially great crimping pressure is reproducibly applied before the pliers may be reopened, for example by a spring. In the completely opened position of the pliers and after the work piece to be crimped has been inserted into the pliers, the pliers may usually not be operated by one hand. However, this is no disadvantage since no crimping forces are applied in this position, but the dies do only have to be closed to surround the work piece. The crimping forces are realized during the crimping steps.

The first portion and the second portion of the divided handle may be designed and arranged to be automatically adjusted to reach the different angle positions between the crimping steps. This means that that the second angle position between the portions of the divided handle is automatically reached and locked after the first crimping step has been finished. It is also possible to choose a semi-automatic design that may depend, for example, on an opening stroke of the handle after the first crimping step. It is preferred to use a spring for this arrangement.

However, the first portion and the second portion of the divided handle may also be designed and arranged to be manually adjustable to reach the different angle positions between the crimping steps. Especially in combination with such a manual adjustment of the two angle positions of the two portions of the divided handle, there are a number of different design possibilities for the person with skill in the art. It is especially simple to design the portions of the divided handle in a way that they may be put together in two different angle positions. A locking mechanism including a ball for securing the positions of the two portions of the divided handle may be used. Additionally or alternately, an elongated hole connection may be arranged to act between the portions of the divided handle to make sure that the portion of the divided handle forming the free end is captivated at the pliers. An elongated hole connection is to be understood as a device including an elongated hole or opening and a pin or bolt engaging the elongated hole.

Another possibility is to interconnect the two portions of the divided handle of the pliers by a joint, on the one hand, and by an elongated hole connection, on the other hand, to be adjustable to alternately reach the two angle positions with respect to each other. The elongated hole connection extends in a transverse direction with respect to the direction of main extension of the two portions of the handle. The elongated hole is located at one portion of the divided handle. A transverse pin or bolt or the like is located at the other portion of the handle. The elongated hole may also be designed as a gate including a plurality of offsets. A locking bolt may be movably guided in one portion of the divided handle, the locking bolt being subject to the pressure of a spring. A stop cooperating with the locking bolt may be arranged at the other portion of the two-part handle. In this way, the angle position being associated with the second crimping step is determined in a semiautomatic fashion when the opening stroke being conducted after the first crimping step has been finished is sufficient.

The pliers may also include a first elongated hole connection and a second elongated hole connection. The two elongated hole connections alternately connect the two portions of the divided handle in two different angle positions. Both elongated hole connections are designed and arranged to allow for a limited movement of the two portions of the handle with respect to one another in their direction of main extension. One of the two elongated hole connections is designed and arranged to allow for a limited movement of the portions of the handle in a direction transverse to their direction of main extension.

It makes sense to arrange the pressure lever to be connected to the portion of the divided handle facing the pliers head. In this way, the same ratio of transmission prevails in each crimping step. Generally, the division or the separation of the divided handle may be realized in way that the portion of the handle facing the pliers head has a lever length being a little less than the lever length of the other portion of the divided handle forming the free end portion.

The locking mechanism may include a tooth segment being fixedly connected to the portion of the divided handle facing the pliers head to be commonly rotated therewith and a locking jack being supported on the pressure lever. With this arrangement, the locking mechanism is arranged at an appropriate location defining the end position of the dies of the pliers. In combination with the use of an eccentric bolt for supporting the pressure lever of the toggle lever drive, the play or looseness prevailing in the joints and the corresponding work tolerances of the elements of the pliers may be adjusted to be very small.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
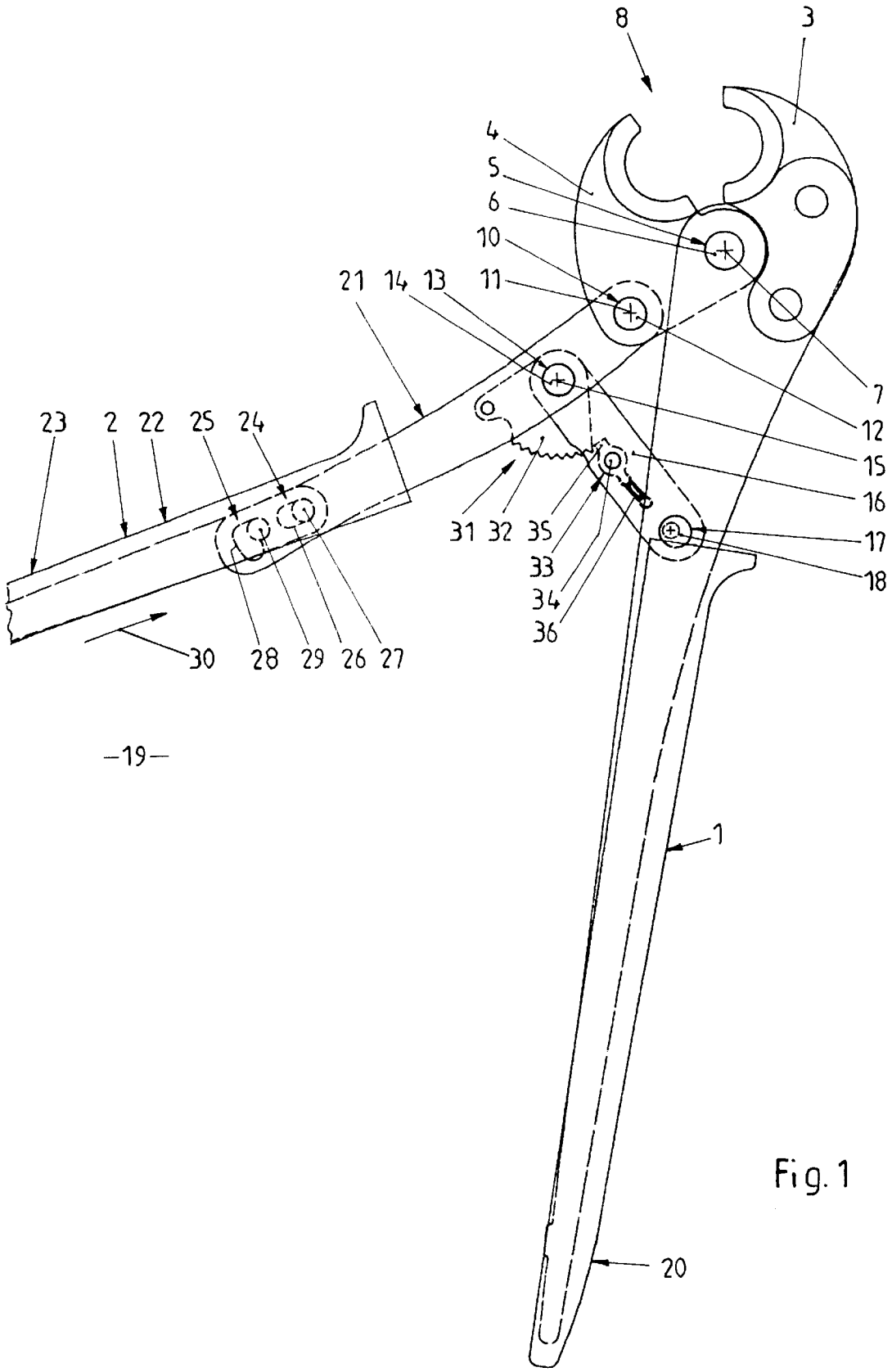
FIG. 1 is a view of a first embodiment of the pliers in their opened position directly after the crimping process has been finished.

Referring now in greater detail to the drawings, FIG. 1 illustrates pliers including handles 1 and 2. The handle 1 is fixedly connected to a pivot jaw 3 to be commonly rotated and such that these two elements form a stationary portion of the pliers. The pivot jaw 3 and the handle 1 may also be designed as one piece. The handle 1 is also referred to as stationary handle, although, for an activation of the pliers, it is only important that there is a relative movement of the handles 1 and 2 with respect to one another. In addition to the stationary pivot jaw 3, there is a movable pivot jaw 4 being pivotally connected to the stationary portion of the pliers 1, 3 by a joint 5. The stationary handle 1 may be designed as a semi shell or to have a plate design such that its legs or plates extend approximately symmetrically to the plane of main extension 19 of the pliers. A pin 6 extends through the legs or plates, the movable pivot jaw 4 being designed and arranged to be pivotal with respect to the stationary pivot jaw 3 about the axis 7 of the pin 6. A crimping die 8 is located at the pivot jaws 3 and 4. The crimping die 8 may be designed to be replaceable or to form one piece with the pivot jaws 3, 4. In the exemplary embodiment of FIG. 1, the crimping die 8 is formed by two dies being designed in the form of semi shells. The semi shells are removeably or replaceably inserted into the pivot jaws 3, 4. The axial length of the semi shells perpendicular to the plane of main extension 19 also forming the plane of illustration covers the length of a union stem onto which, for example, a tube is to be connectingly and sealingly crimped. Preferably, the axis 9 (FIG. 5) of the crimping die 8 is to be located close to the joint 5, meaning at a distance between the axis 7 and 9 being chosen to be as small as possible.

The movable pivot jaw 4 being associated with the movable handle 2 is enlarged in a lateral direction with respect to the stationary handle 1 to arrange a first support joint 10, the axis 11 of which being formed by a pin 12. The movable handle 2 engages the pin 12.

A second support joint 13 is arranged at the movable handle 2, the support joint 13 being formed by a pin 14 having an axis 15. A pressure lever 16 being arranged between the handles 1 and 2 is pivotally supported by the pin 14. The other end of the pressure lever 16 is pivotally supported in a third support joint 17. The support joint 17 may be formed by an eccentric pin 18. The eccentric surface of the eccentric pin 18 supports the pressure lever 16. The eccentric pin 18 is rotateably connected to the stationary handle 1. The eccentric cam is of the eccentric pin 18 is dislocated with respect to the pressure lever 16 during rotation. Thus, eccentricity changes its position. The eccentric pin 18 at its circumference includes a plurality of notches to change eccentricity and the effective length of the pressure lever 16.

The stationary handle 1 is designed as a continuous lever. Thus, the length of the lever of the stationary handle 1 corresponds to the distance between the joint 5 and its free and portion 20. The movable lever 2 is divided into two portions 21 and 22 having approximately the same lever length. The total lever length of the movable handle 2 extends from the joint 10 to the end portion 23 of the movable lever 2. In the close position of the pliers, the end portion 23 of the movable handle 2 is located adjacent to the end portion 20 of the stationary handle 1.

The two portions 21 and 22 of the movable lever 2 may support one another in at least two relative positions or angle positions. Each angle position is associated with a crimping step. However, there may be more than two angle positions. To emphasize the basic design of the novel pliers, the drawings only show at exemplary embodiments in which the movable handle 2 is divided into two portions 21 and 22 being lockable with respect to one another in two different angle positions. Additionally, in the illustrated embodiments, the novel design of the pliers has only been applied to the movable handle 2. It is to be understood that the novel division or separation may also be realized exclusively at the stationary handle 1, or at both handles 1 and 2 at the same time.

In the exemplary embodiment of the pliers according to FIG. 1, the two portions 21 and 22 are designed and arranged to be interconnectable in two different angle positions by two elongated hole connections 24 and 25. The elongated hole connection 24 includes an elongated hole 26 and a transverse bolt 27. The elongated hole 26 substantially extends approximately in the direction of main extension of the handle 2. The elongated hole connection 25 also includes an elongated hole 28 and a transverse bolt 29. The elongated hole 28 includes a first portion extending approximately in the direction of main extension of the handle 2 and being located in alignment with or parallel to the elongated hole 26. However, the elongated hole 28 additionally includes a second portion extending substantially transverse to the direction of main extension of the lever 2. The distribution and the arrangement of the transverse bolts 27 and 29, on the one hand, and of the elongated holes 26 and 28, on the other hand, with respect to the portions 21 and 22 of the handle 2 are variable. For example, the distribution and the arrangement may be changed, as it is to be seen from a comparison of the embodiments of the pliers of FIGS. 1 and 2. For example, when the transverse bolts 27 and 29 are located on the portion 21 (FIG. 1), and the elongated holes 26 and 28 are located the portion 22, a first angle position between the portions 21 and 22 is possible. In this first angle position, both portions 21 and 22 enclose an angle being a little less than 180 degrees. The angle being less than 180 degrees is located on the outside of the movable handle 2, as it is illustrated in FIG. 1. This angle position or relative position of the two portions 21 and 22 of the handle 2 is the one occurring at the end of the crimping process of a work piece (FIG. 5). This angle position is also taken by the two portions 21 and 22 during the entire second crimping step (FIGS. 4 and 5).

Figure 2:
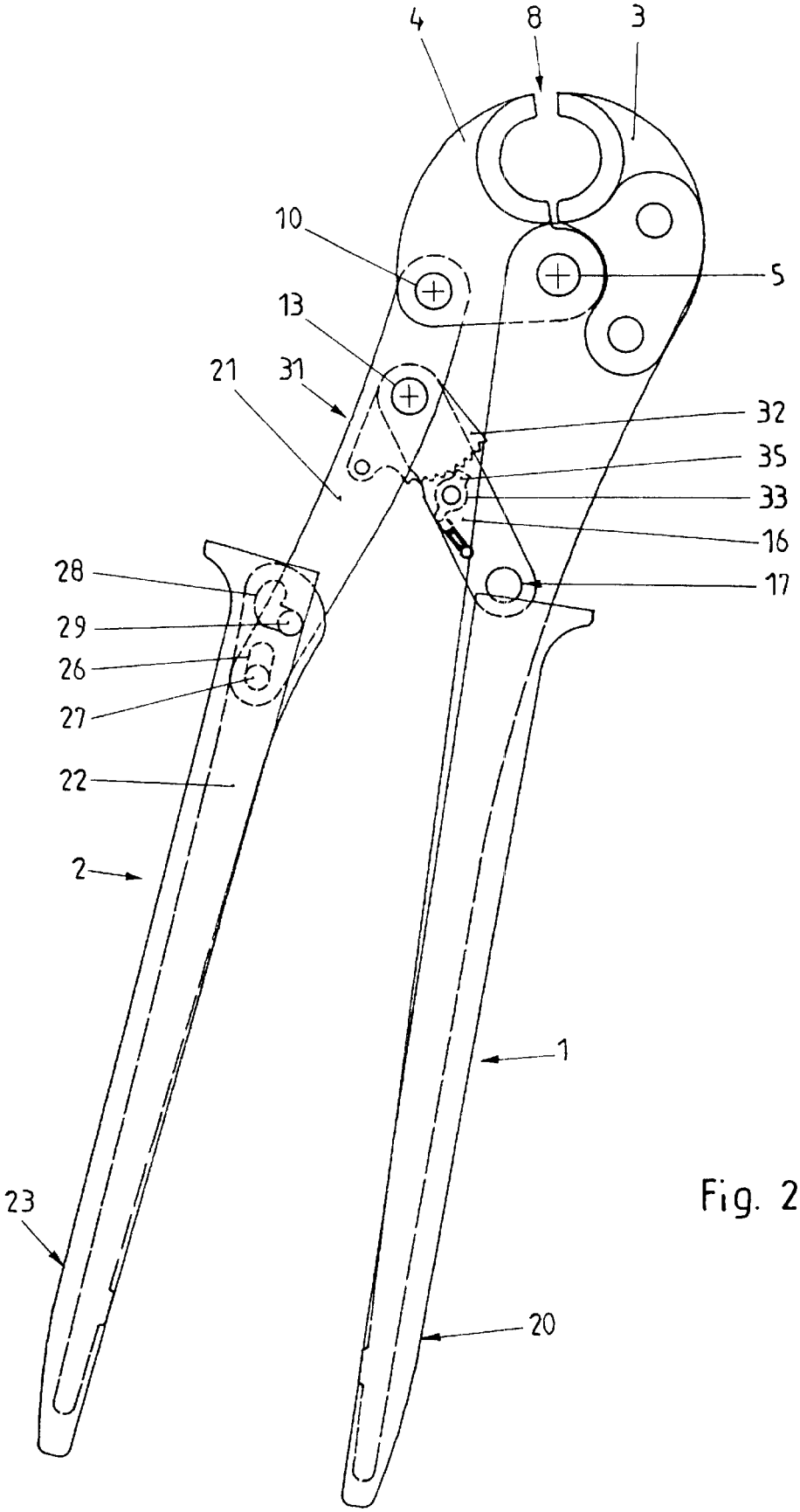
FIG. 2 is a view of the pliers of FIG. 1 at the beginning of the first crimping step.

In the completely opened position of the pliers according to FIG. 1, the dies of the crimping die 8 are located at the greatest distance with respect to one another. Consequently, a crimped work piece may be easily taken out off the pliers, and a work piece to be crimped may be easily inserted into the pliers. Before this or after this, the other angle position between the portions 21 and 22 at the handle 2 is being adjusted, as it is also necessary at the beginning of the first crimping step (FIG. 2). The angle being enclosed between the portions 21 and 22 and being a little less than 180 degrees is now located on the other side of the portions 21 and 22. To reach the second angle position according to FIG. 2—starting from the angle position according to FIG. 1—it is only necessary to move the portion 22 with the elongated holes 26 and 28 with respect to the transverse bolts 27 and 28 according to arrow 30 about the possible stroke and in an inward direction, and to pivot the portion 22 about the transverse bolt 27 forming ajoint such that the portions 21 and 22 take the relative position as illustrated in FIG. 2. In case the arrangement of the elongated holes 26 and 28 on the portion 22 is inverted, as this is illustrated in FIG. 2, the portion 22 also has to be pressed in the direction according to arrow 30. When the arrangement of the transverse bolts 27 and 29, on the one hand, and of the elongated holes 26 and 28, on the other hand, is inverted on the portions 21 and 22, there is a corresponding necessity of movement.

FIG. 2 illustrates the relative position of the portions 21 and 22 of the handle 2 with respect to the handle 1 at the beginning of the first crimping step. The work piece (not illustrated) has already been inserted into the crimping die 8, and the pliers have been located to surround the work piece, respectively, and they have been moved from the opened position according to FIG. 1 into an intermediate position in which the first crimping step may start. It is now assumed that the dies of the crimping die 8 do surround the deformable work piece at this moment for the first time. Consequently, it will be necessary at the beginning of the first crimping step to provide the crimping forces necessary for deforming the work piece. However, these necessary crimping forces may have an extremely great value. The angle position between the portions 21 and 22 at the handle 2, as illustrated in FIG. 2, is chosen, dimensioned and arranged such that the free end portions 20 and 23 of the handles 1 and 2 are arranged at a distance being less than approximately 110 mm. This distance is small enough to enable the operator of the pliers to grasp, hold and operate the two handles 1 and 2 in the region of the end portions 20 and 23 with the fingers of one hand.

Figure 3:
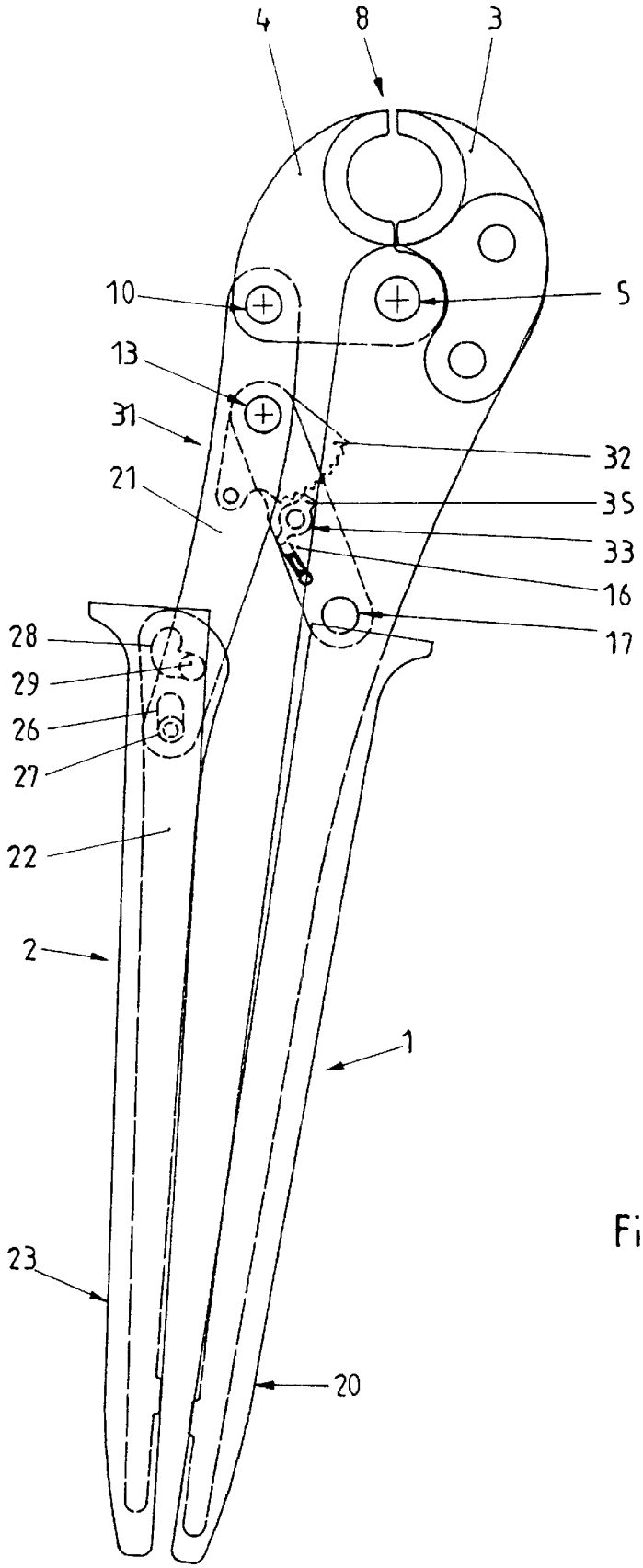
FIG. 3 is a view of the pliers of FIG. 1 at the end of the first crimping step.
Figure 4:
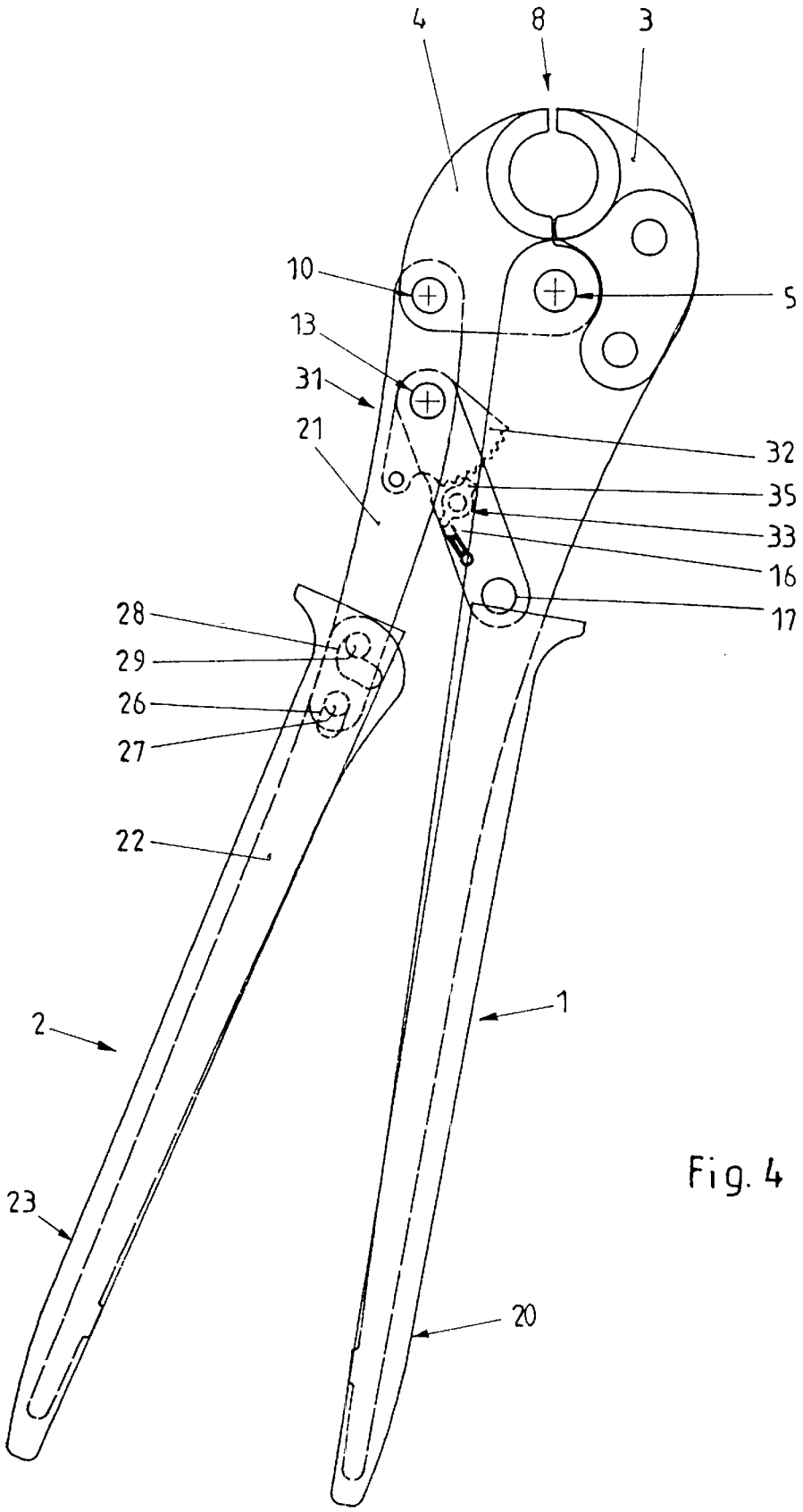
FIG. 4 is a view of the pliers of FIG. 1 at the beginning of the second crimping step.
Figure 5:
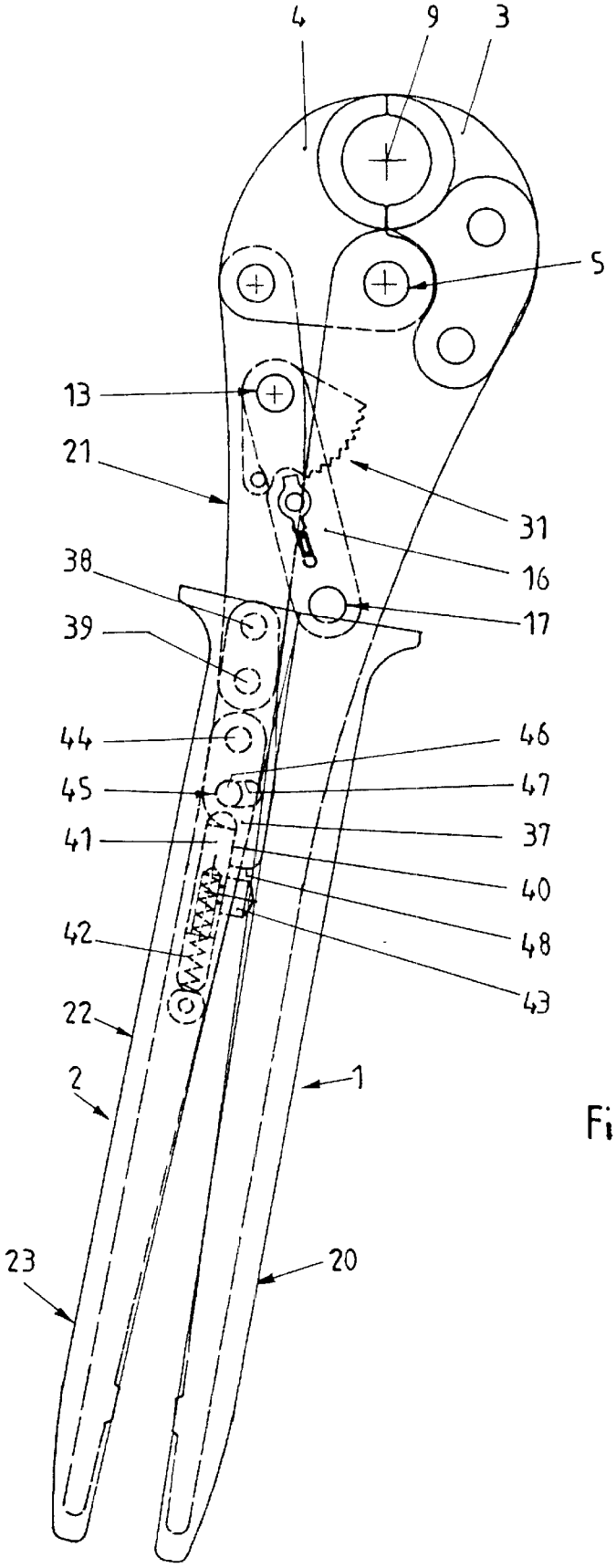
FIG. 5 is a view of another exemplary embodiment of the pliers at the end of the second crimping step.

After the first crimping step has been finished, meaning the two handles 1 and 2 have been pressed towards each other, as illustrated in FIG. 3, the pliers are moved into the position of FIG. 4 to prepare the second crimping step. The portion 22 of the handle 2 is being pivoted in an opening sense between the positions of FIGS. 3 and 4 about the transverse bolt 27. It is slightly pulled out in a direction opposite to arrow 30 until the locking position of the portions 21 and 22 according to FIG. 4 has been reached. In this position, the two end portions 20 and 23 of the handles 1 and 2 are located at a distance with respect to each other being less than approximately 110 mm, again. Consequently, the operator may also grasp, hold and operate the handles 1 and 2 with the fingers of one hand to conduct the second crimping step. However, the operator may additionally use the second hand to increase the applied crimping force if necessary and adequate.

The end of the second crimping step and, consequently, the complete desired crimping process of the work piece, has been reached after the handles 1 and 2 have taken the end position of FIG. 5.

The pliers include a locking mechanism 31 to reproducibly coordinate the movement of the crimping process including the two crimping steps including the prearranged closing of the crimping die 8, and to reliably attain the end position of the closing position according to FIG. 5 starting from the completely opened position according to FIG. 1. The locking mechanism 31 includes a tooth segment 32 and a locking jack 33. The tooth segment 32 may be fixedly connected to the portion 21 of the movable handle 2 to be commonly rotated therewith. However, the tooth segment 32 may also be designed as one piece with the portion 21, or it may be connected to the movable pivot jaw 4. There also are a number of possibilities for the design and arrangement of the locking jack 33. In the illustrated exemplary embodiment, the locking jack 33 is supported at a bolt 34 to be freely rotatable. The bolt 34 is arranged at the pressure lever 16. The locking jack 33 includes a ratchet 35. The locking jack 33 being located on the bolt 34 to be freely rotatable in both directions is subject to the force of a spring 36. When the ratchet 35 is free from engagement, the spring 36 provides for the starting position of the locking jack 33 according to FIG. 1. The spring 36 may be connected to an opening being located at the pressure lever 16. The ratchet 35 of the locking jack 33 cooperates with the teeth of the tooth segment 32 in both directions of movement. A free pivot portion is arranged at each end of the teeth of the tooth segment 32.

The operation and the effects of such a locking mechanism 31 are well known in the art. The locking mechanism 31 already engages during the closing movement of the pliers and of the crimping die 8, respectively, about the work piece, as this is shown by the position according to FIG. 2. Then, it is no longer possible to open the pliers. Instead, the entire crimping process including the two crimping steps has to be conducted. In this way, it is ensured that the two crimping steps are realized in the desired and predetermined order one after the other, and as it makes sense and as it is necessary to correctly crimp the work piece. The relative positions of the elements of the locking mechanism 31 are to be seen from the series of drawings according to FIG. 1 through FIG. 5. Additionally, the association of these elements with the two crimping steps is to be seen from the drawings according to FIG. 1 through FIG. 5.

FIG. 5 does not only show the end position of the elements of the novel pliers at the end of the second crimping step or stage, but also the another exemplary embodiment of the novel pliers. The portion 21 of the divided handle 2 is designed as a two-piece element for reasons of manufacture. The pliers include a stop element 37 including two pins 38 and 39 by which it is fixedly connected to the portion 21 to be commonly rotated therewith. The stop element 37 includes a step or a stop 40 for the engagement with a locking pin 41 being arranged on a spring 42 in the direction of the extension of the portion 22 of the handle 2. An actuation button 43 allows for the manual pressing of the locking pin 41 back against the force of the spring 42. The portions 21 and 22 of the movable handle 2 are interconnected by a joint 44 and an elongated hole connection 45. The elongated hole connection 45 includes a transverse bolt 46 and an elongated hole 47. It is to be seen from FIG. 5 that the elongated hole 47 extends approximately transverse to the direction of main extension of the handle 2. For example, the transverse bolt 46 is arranged on the portion 22 of the handle 2. The elongated hole 47 is arranged on the stop element 37.

The exemplary embodiment of the novel pliers according to FIG. 5 makes it possible to operate the pliers in a semi-automatic fashion. During the first crimping step, the crimping forces acting between the portions 22 and 21 are transmitted by the joint 44 and the elongated hole connection 45, while the locking pin 41 is supported at a face 48 of the stop element 37 under the force of the spring 42. After the first crimping step has been finished, only an opening stroke between the handles 1 and 2 has to be realized until the locking pin 41 gets free from contact to the face 48, and it is capable of engaging the stop 40 due to the force of the spring 42, as this is illustrated FIG. 5. Then, the second crimping step may take place. The locking mechanism 31 is designed and arranged to be coordinated with the semiautomatic operation of the novel pliers.

Many variations and modifications may be made to the preferred embodiments of the invention without departing substantially from the spirit and principles of the invention. All such modifications and variations are intended to be included herein within the scope of the present invention, as defined by the following claims.

I claim:

1. Pliers for crimping work pieces, comprising:

a pliers head;

a first pivot jaw being arranged in the region of said pliers head;

a second pivot jaw being arranged in the region of said pliers head;

a common joint pivotally connecting said first and second pivot jaw;

a first die being arranged at said first pivot jaw;

a second die being arranged at said second pivot jaw, said first and second die together forming a crimping die;

a first handle being operatively connected to said first pivot jaw and including an end portion facing away from said pliers head, said first handle being divided into at least a first portion and a second portion;

a second handle being operatively connected to said second pivot jaw and including an end portion facing away from said pliers head, said first handle and said second handle being designed and arranged to be movable with respect to one another and to be operable to crimp the work piece by at least two successive crimping steps, said second portion of said first handle being coupled to said first portion of said first handle to enable a plurality of different angle positions each corresponding to one of said at least two successive crimping steps in a way that said end portions of said first handle and said end portion of said second handle may be held and operated by the fingers of one hand in each angle position of each crimping step;

a locking mechanism being designed and arranged to attain a defined closed position of said first die and said second die and to maintain the closed position of said dies between said successive crimping steps; and a toggle lever drive including a plurality of supporting joints and a pressure lever operatively connecting said first handle and said second handle, said pressure levet being supported by said plurality of supporting joints.

2. The pliers of claim 1, wherein said locking mechanism is operatively arranged between said first handle and said second pivot jaw.

3. The pliers of claim 1, wherein said first portion and said second portion are designed and arranged to be automatically adjusted to reach the different angle positions between the crimping steps.

4. The pliers of claim 1, wherein said first portion and said second portion are designed and arranged to be manually adjustable to reach the different angle positions between the crimping steps.

5. The pliers of claim 3, further comprising a joint and an elongated hole connection connecting said first portion and said second portion to alternately reach two different angle positions.

6. The pliers of claim 4, further comprising a joint and an elongated hole connection connecting said first portion and said second portion to alternately reach two different angle positions.

7. The pliers of claim 5, further comprising:

a locking pin being movably arranged in said second portion of said first handle;

a spring being arranged in said second portion of said first handle and being designed and arranged to subject said locking pin to a pushing force; and a stop being arranged at said first portion of said first handle and being designed and arranged to cooperate with said locking pin.

8. The pliers of claim 6, further comprising:

a locking pin being movably arranged in said second portion of said first handle;

a spring being arranged in said second portion of said first handle and being designed and arranged to subject said locking pin to a pushing force; and a stop being arranged at said first portion of said first handle and being designed and arranged to cooperate with said locking pin.

9. The pliers of claim 3, further comprising a first elongated hole connection and a second elongated hole connection, said two elongated hole connections alternately connecting said first portion and said second portion of said first handle in two different angle positions, said two elongated hole connections being designed and arranged to allow for a limited movement of said first portion and of said second portion of said first handle with respect to one another in their direction of main extension, and wherein said second elongated hole connection is designed and arranged to allow for a limited movement of said first portion and of said second portion of said first handle in a direction transverse to their direction of main extension.

10. The pliers of claim 4, further comprising a first elongated hole connection and a second elongated hole connection, said two elongated hole connections alternately connecting said first portion and said second portion of said first handle in two different angle positions, said two elongated hole connections being designed and arranged to allow for a limited movement of said first portion and of said second portion of said first handle with respect to one another in their direction of main extension, and wherein said second elongated hole connection is designed and arranged to allow for a limited movement of said first portion and of said second portion of said first handle in a direction transverse to their direction of main extension.

11. The pliers of claim 3, wherein said first portion and said second portion of said first handle are designed and arranged to be put together in two different angle positions.

12. The pliers of claim 4, wherein said first portion and said second portion of said first handle are designed and arranged to be put together in two different angle positions.

13. The pliers of claim 2, wherein said pressure lever is connected to said portion of said first handle facing said pliers head.

14. The pliers of claim 13, wherein said locking mechanism includes a tooth segment being fixedly connected to said portion of said first handle facing said pliers head to be commonly rotated therewith and a locking jack being supported on said pressure lever.

15. The pliers of claim 1, wherein the work piece is chosen from a group consisting of fittings, tubes and cable lugs.

* * * * *